United States Patent [19]

Summers

[11] 4,000,748

[45] Jan. 4, 1977

[54] APPARATUS AND PROCESS FOR SHREDDING AND CRIMPING SMOKING MATERIALS

[75] Inventor: Thomas Wade Summers, Fern Creek, Ky.

[73] Assignee: Brown & Williamson Tobacco Corporation, Louisville, Ky.

[22] Filed: Jan. 30, 1975

[21] Appl. No.: 545,442

Related U.S. Application Data

[63] Continuation-in-part of Ser. No. 459,497, April 10, 1974, abandoned.

[52] U.S. Cl. ..... 131/140 C; 241/236

[51] Int. Cl.[2] ..... A24B 3/18; B02C 7/04

[58] Field of Search ..... 131/140 R, 140 C, 20; 83/105; 241/236

[56] References Cited

UNITED STATES PATENTS

| | | | |
|---|---|---|---|
| 2,613,673 | 10/1952 | Sartoretto et al. | 131/140 C X |
| 3,204,641 | 9/1965 | Jones | 131/140 R |
| 3,299,895 | 1/1967 | Dearsley | 131/140 C X |
| 3,429,317 | 2/1969 | Koch et al. | 131/140 R |
| 3,516,315 | 6/1970 | Suzuki | 83/105 X |
| 3,630,460 | 12/1971 | Goldhammer | 241/236 |

*Primary Examiner*—Robert W. Michell
*Assistant Examiner*—V. Millin
*Attorney, Agent, or Firm*—William J. Mason

[57] ABSTRACT

Apparatus and method are provided for the substantially simultaneous shredding and crimping of smoking material, such as reconstituted tobacco, into strips of the material. The crimped strips provide tobacco smoking material having substantially increased fill value.

7 Claims, 6 Drawing Figures

FILLING VALUE (mg/cc)
200
190
180
170
160
150
140
130
62
60
10
20
30
SHREDDING MOISTURE (%)

% - 30 MESH (FINES)
10
5
66
64
LEVEL PRODUCED BY CONVENTIONAL CUTTING
5
10
15
20
25
30
SHREDDING MOISTURE (%)

APPARATUS AND PROCESS FOR SHREDDING AND CRIMPING SMOKING MATERIALS

RELATED APPLICATIONS

This is a continuation-in-part of U.S. Ser. No. 459,497 filed Apr. 10, 1974 now abandoned.

FIELD OF INVENTION

The present invention is related to apparatus and process for shredding sheets of smoking material into crimped strips.

BACKGROUND OF THE INVENTION

Manufacturers of tobacco products are continually striving to find more economical ways of utilizing the various smoking materials comprising the products. For example, considerable effort is being made to increase the physical size of tobacco in various forms through expansion processes, such as steaming and rapid heating of tobacco containing readily volatizable agents. Such expansion processes not only provide the tobacco with increased fill power, but also provide a viable way of reducing and controlling the delivery of the various smoke constituents.

Reconstituted tobacco or tobacco substitute materials in sheet form may also be expanded for the advantages enumerated above. It has also been found that sheet smoking materials may be crimped, generally into strip form, to provide increased fill value. Crimping prevents the strips from settling or packing together due to the geometric configuration. Cigars and cigarettes filled with crimped smoking material are characterized by being firmer, yet provide the manufacturer with increased yield of product for a given weight of smoking material or, in other words, increased fill value.

There are a number of techniques described in the prior art for crimping smoking materials. For example, according to U.S. Pat. No. 1,647,694, crimped strips may be produced from a compacted mass of tobacco leaves by cutting the mass with an appropriately shaped edge into strips having a shape similar to the cutting edge. The patentee alleged that an increase in filling value of up to 10% can be obtained into products made from the strips. Obviously, it is the geometry of the strips which provides the increased fill value.

Other prior art apparatus and process employ shaped rollers which crimp already severed strips into the desired shape. Still other techniques for shaping strips are employed, such as cutting strips, which are bent, obliquely across the bend, thereby providing the strips with a crimp in the plane of the strip.

No entirely satisfactory method has been devised, however, which provides manufacturers with simple process and apparatus for crimping strips of tobacco material. The prior art is replete with complex mechanisms and/or processes for shaping tobacco materials. It is, therefore, a paramount object of the present invention to provide for simple apparatus and method for manufacturing crimped strips of tobacco smoke material.

SUMMARY OF THE INVENTION

The present invention provides for the shredding of a sheet of tobacco material into strips or ribbons and crimping the resultant strips in a substantially simultaneous operation. In accordance with one embodiment of the present invention, a sheet of tobacco material is moved while maintained at a moisture level between 15 and 30% by weight and then shredded into strips about 0.65 to 1.55 mm wide. The motion of the resultant strips is then retarded so that its relative speed is less than that of the sheet as it is being shredded, causing a buckling of the strips into a crimped configuration.

Apparatus for crimping strips of tobacco material in accordance with a preferred embodiment of the present invention comprises a pair of intermeshing stacks of disks and two sets of guide means, one for each stack. Hereinafter the terms "disks" and "disk" are defined to means a flat planar body having substantially uniform thickness as opposed to rotating cutter disks which have peripheries in the form of a knife edge. A sheet of tobacco material is moved between the stacks which shred the sheet into a plurality of strips. Each strip frictionally engages the rotating planar surface of "neighboring disks" at a point inside of the "opposing disk," reducing or retarding its speed, causing each strip to buckle into a crimped configuration. Neighboring disks are defined as adjacent disks of a stack, while opposing disk means the disk which intermeshed with and extends between neighboring disks. Finally, a plurality of guide means guide each strip from between neighboring disks into an appropriate collection device for further processing.

Crimped shreds made in accordance with the present invention provide an increase in fill value of 10% or more.

DETAILED DESCRIPTION

Figure 1:
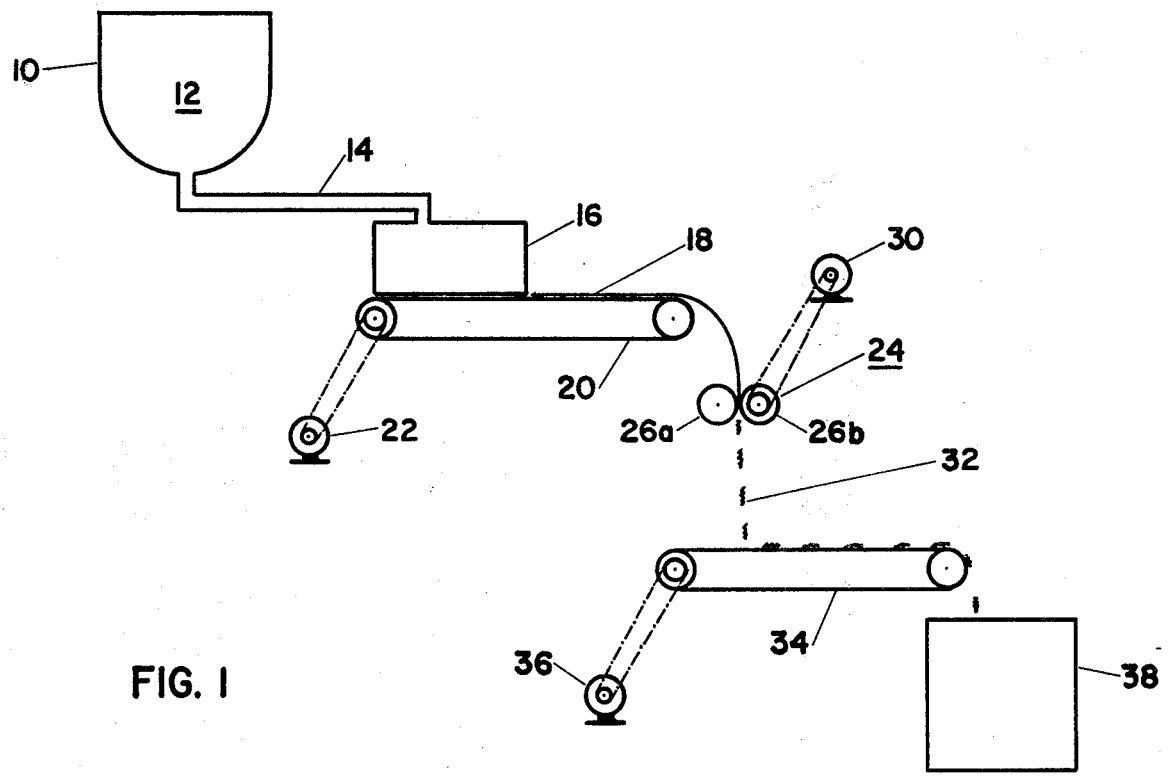
FIG. 1 is a schematic illustration of one embodiment of the present invention employed with a tobacco sheet casting device.

Generally, most sheets of reconstituted tobacco are cast from a slurry, as illustrated in FIG. 1, in which is shown a reservoir 10 holding a slurry 12 of a tobacco product which may be a mixture of tobacco fines and binders. Reservoir 10 communicates through piping 14 with the casting apparatus 16, which casts or extrudes a sheet 18 upon conveyor 20, powered by motor 22. The details of casting apparatus 16 are not described, since such casting operations are well-known in the industry and the precise details do not form part of this invention. Conveyor 20 moves sheet 18 to a shredder assembly 24, which is comprised of a stacked pair of intermeshed disks 26a, 26b which rotate in response to motor 30. Sheet 22 is shredded and crimped into strips 32 which fell upon and conveyed away by conveyor 34 and drive 36 to a drier or bulker 38.

Figure 2:
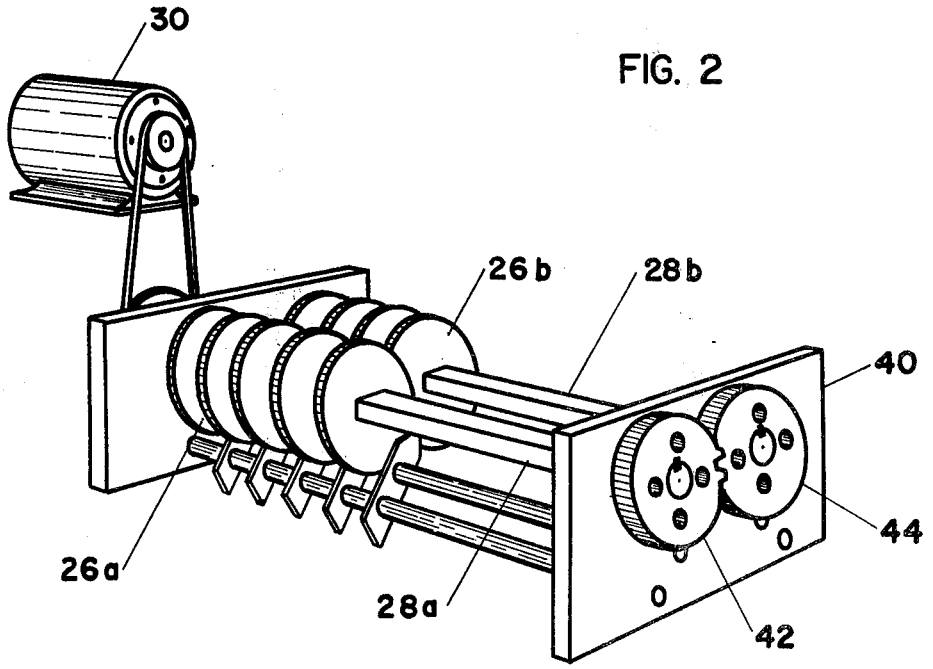
FIG. 2 is a perspective view of a preferred embodiment of the present invention.

Shredder assembly 24 may be best seen in the perspective view of FIG. 2. To facilitate description, spacings between the disks and other dimensions are exaggerated. Stacks 26*a*, 26*b* are illustrated as intermeshed and rotatably secured to frame 40 via axles 28*a* and 28*b*. Stacks 26*a*, 26*b* are coupled to one another via meshed gears 42, 44. Gear 42 via axle 28*a* is driven by motor 30. Each stack 26*a*, 26*b* is accompanied by a set of guides 48*a*, 48*b* fixedly secured to frame 40 and extended between neighboring disks. Guides 48 serve the functions of guiding crimped material from between neighboring disks of stacks 26*a*, 26*b* and preventing undue accumulation or buildup of material about axles 28*a* and 28*b*.

Figure 3:
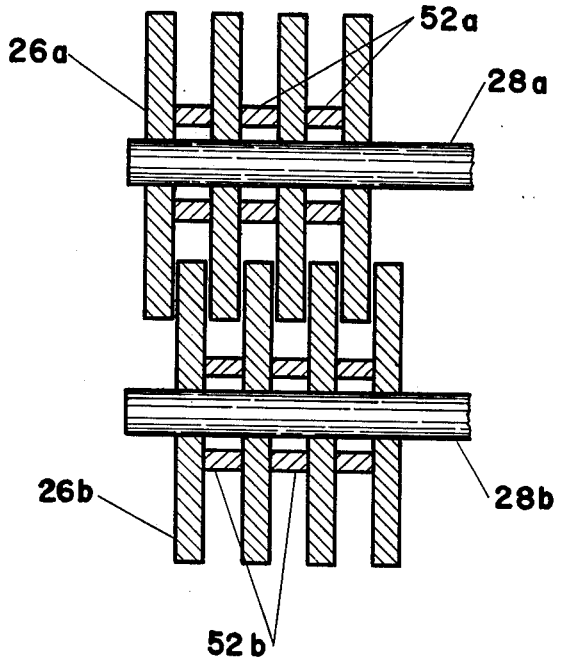
FIG. 3 is a fragmentary view of a disk and spacer assembly as seen along a plane defined by the axis of rotation of the two stacks where the dimensions are exaggerated to promote clarity.

A fragmented, cross-sectional view of a shredding assembly 24 may be seen in FIG. 3. An important feature shown is the spacing of neighboring disks by spacer rings 52*a*, 52*b*. The distance between neighboring disks is determined largely by the width of the strip desired, although upper and lower limits must be observed. Changing the spacing is accomplished by choosing between varying thickness of spacers 52*a*, 52*b* and disks of stacks 26*a*, 26*b*.

The peripheral surface of the disks may be knurled or otherwise treated to facilitate frictional engagement of the sheet. It is necessary to employ disks with substantially uniform thickness. Knife-edge disks have been found not to be satisfactory in the shredding and crimping of the tobacco sheet materials, because the knife-edges continually require sharpening and do not provide crimped strips.

It is easy to control blending percentages in a composition when all ingredients are readily flowable and consist of fine particles. The smaller the particles, the more precise blending which can be attained. To a degree, tobacco handles in the same manner. Large strips of tobacco are exceptionally difficult to blend due primarily to the high frictional characteristics and fibrous nature of tobacco. It has been found, for example, that below about 0.6 cuts per millimeter (16 cuts/inch) the strips do not blend with the degree needed to fall within practical deviations or limits of error.

While, theoretically, blending becomes easier and more precise as the cuts per unit length increases, it has been noted that strips of tobacco material begin to break up into small particles or fines when the cuts per unit length exceed about 1.57 cuts/mm (40 cuts/inch). Break-up is particularly aggravated by low moisture levels. Thus, it has been found to be necessary to space neighboring disks about 0.65 mm to 1.55 mm apart and preferably about 0.80 mm to 1.20 mm.

It has been found that it is necessary to reduce the linear velocity of the newly formed shred to obtain the desired crimp in the same operation. This simultaneous shredding and crimping occurs only when certain values of "disk overlap ratios" and opposing disk clearances are observed. The reduction in linear velocity results from engagement of the sides of the shreds with the planar surfaces of the neighboring disks. Crimping has been found to occur only when the "disk overlap ratio" is 0.045 or greater. Disk overlap ratio is defined for purposes of this disclosure as the ratio of the overlap of opposing disks to the diameter of the disks. Additionally, it has been determined that crimping will not occur unless the clearances between opposing disks is between about 11% to 46% of the width of the disks. It is believed that the reason that such a clearance range is needed is because the shreds are only slightly wider than the width of the disks. Consequently, opposing disks must be spaced close together to provide an appropriate frictional surface for contact with edges of the shreds.

Moisture level of the tobacco sheet material is an important consideration in crimping. At moisture levels below about 15% by weight of the tobacco material, the crimp disappears with concomitant increase in the generation of tobacco fines. Although it is not critical to maintain the sheet moisture below about 30% by weight moisture in order to produce crimped strands, it was determined that sheets with excessive moisture levels do not ordinarily retain sufficient integrity to undergo shredding and, instead, deteriorate into a gummy mass, which may bridge between neighboring and opposing disks and cause jamming of the apparatus. Thus, it is critical to ensure sheet moisture levels are about 15% by weight and necessary, as a practical matter, to maintain moisture levels below abcut 30% by weight. Optimum moisture levels appear to be between 16–23% by weight.

Figure 4:
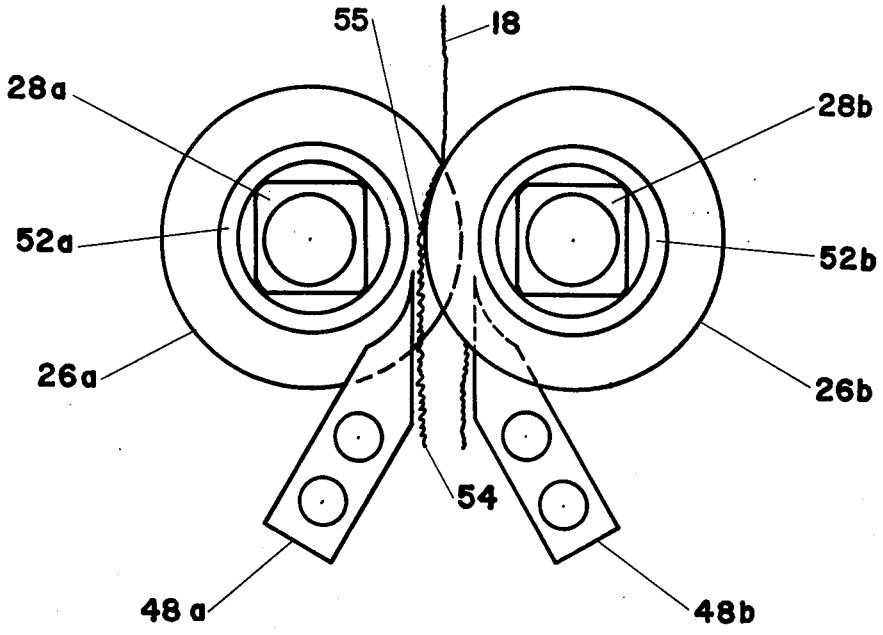
FIG. 4 is a side view of a pair of opposing disks and guide elements.

FIG. 4 illustrates a pair of opposing disks 26*a*, 26*b* shredding sheet 18 into a strip 54. A pair of guides 48*a*, 48*b* are positioned adjacent disks 26*a*, 26*b*. Spacer rings 52*a*, 52*b*, which may be made of brass, for example, are coaxially mounted about axles 56*a*, 56*b*, which are keyed to disks 26*a*, 26*b*.

Guides 48*a*, 48*b* preferably have a width much less than rings 52*a*, 52*b* so as to present as small a surface area as possible parallel to the surface area of neighboring disks. Large surface areas allow particles to adhere and bridge to neighboring and opposing disks, causing jamming and other operating problems. By reducing the surface area of the guides, the probability of operating problems is also reduced. The preferable area of guides 48*a*, 48*b* as a ratio to neighboring disk area is about 0.135.

Referring again to FIG. 4, it may be seen that the strip 54 follows a path around disk 26*a* where it encounters guide 48*a* which guides strip 54 out from between disk 26*a* and its neighboring disk. As is well-known, the angular velocity is greatest on the periphery of a rotating disk and becomes less at points closer to the center of rotation of the disk. Consequently, the speed of strip 54 is reduced, since it is forced between disc 26*a* and its neighboring disk and the edges of strip frictionally rub the planar surfaces of the disks. Because the portion of the strip between neighboring disks is now moving at a slower speed, buckling or crimpling of the strip begins to occur. Maximum crimping occurs at the point where strip 54 penetrates closest to the center of rotation. By way of example, the point of maximum crimping is illustrated as point 55 in FIG. 4. As stated hereinbefore, however, it is necessary to observe the clearances between opposing disks or no crimping will occur.

It has further been found that feeding a single thickness or monolayer into a shredder apparatus of the present invention provides a superior crimped product to similar products formed from multilayers. Monolayer crimped products, shredded and crimped by method and apparatus of the present invention, are characterized by longer length and higher fill power.

Additionally, shredding a cast sheet in the direction of casting provides a similarly superior crimped product, which is particularly evident when a reconstituted product is blended with conventional cut tobacco into cigarettes. The potential of the crimped product to generate fines during the blending process is lower than the potential of crimped strips which were shredded across the direction of casting.

The following examples are illustrative of the present invention, but should not be considered limiting in any instance:

EXAMPLE 1

Reconstituted tobacco sheets were cut into strips using conventional cutting equipment. Moisture levels at cutting were maintained at the 20% level. The filling value was measured at 162 mg per cc. The shredded material was then screened over a 30 mesh sieve to determine the level of fines generated by conventional cutting at the 20% moisture level. The fines generated were found to be about 1% by weight. Cigarettes were then made from a blend of the reconstituted tobacco strips and conventionally cut tobacco. Winnowers were removed from the making machines and examined for the level of reconstituted tobacco. A reconstituted level of 20% was noted.

EXAMPLE 2

Figure 5:
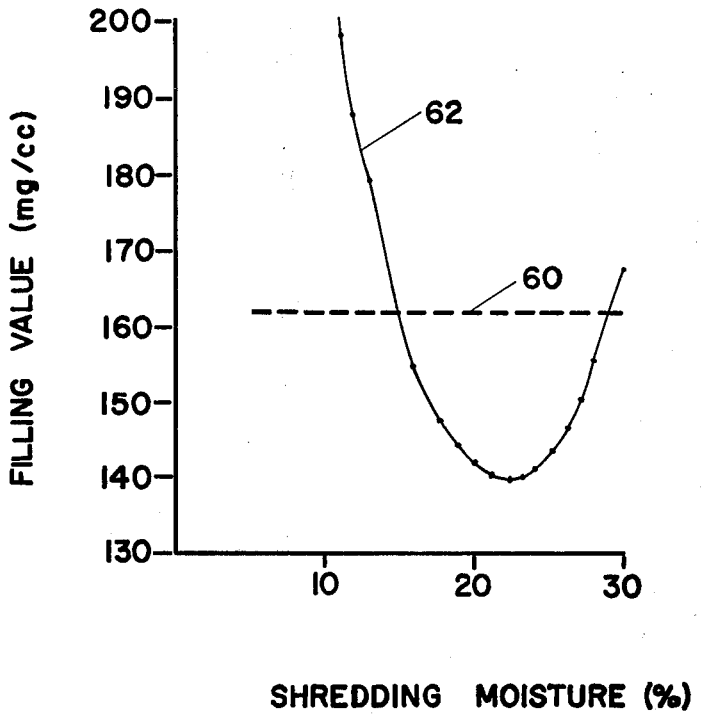
FIGS. 5 and 6 are, respectively, graphical illustrations of filling power as a function of the shredding moisture level and percent generated fines as a function of the shredding moisture level.

Reconstituted tobacco sheets, identical to those used in Example 1 but at various moisture levels, were shredded on equipment typified by that shown in FIGS. 2 and 3 observing the critical parameters as set forth for opposing disk overlap ratio and clearance. The clearance between opposing disks was about 11% of the width of the disks, while the disk overlap ratio was about 0.125. The shreds at the various moisture levels were then evaluated for filling value. The filling power, which is a measure of crimp in the strips, was found to be a function of the shredding moisture. FIG. 5 illustrates this graphically. The dashed line 60 represents the filling value of 162 mg/cc determined in Example 1. It is noted that at approximately the 15% moisture level (represented by the intersection of lines 62 and 60) the filling value approaches that of uncrimped strips of Example 1. Observations of the strips at this moisture level confirmed the absence of discernible crimp. At values of moisture level between about 15% to 30%, the filling value is greater than 162 mg/cc. The curve peaks at about 22% moisture level, providing a fill value increase of greater than 20%. Increasing moisture levels begins to result in a decline in fill value from the peak fill value. At about 29% moisture levels, other factors come into play, resulting in further decreases in fill value beyond the level of uncrimped strips.

EXAMPLE 3

Figure 6:
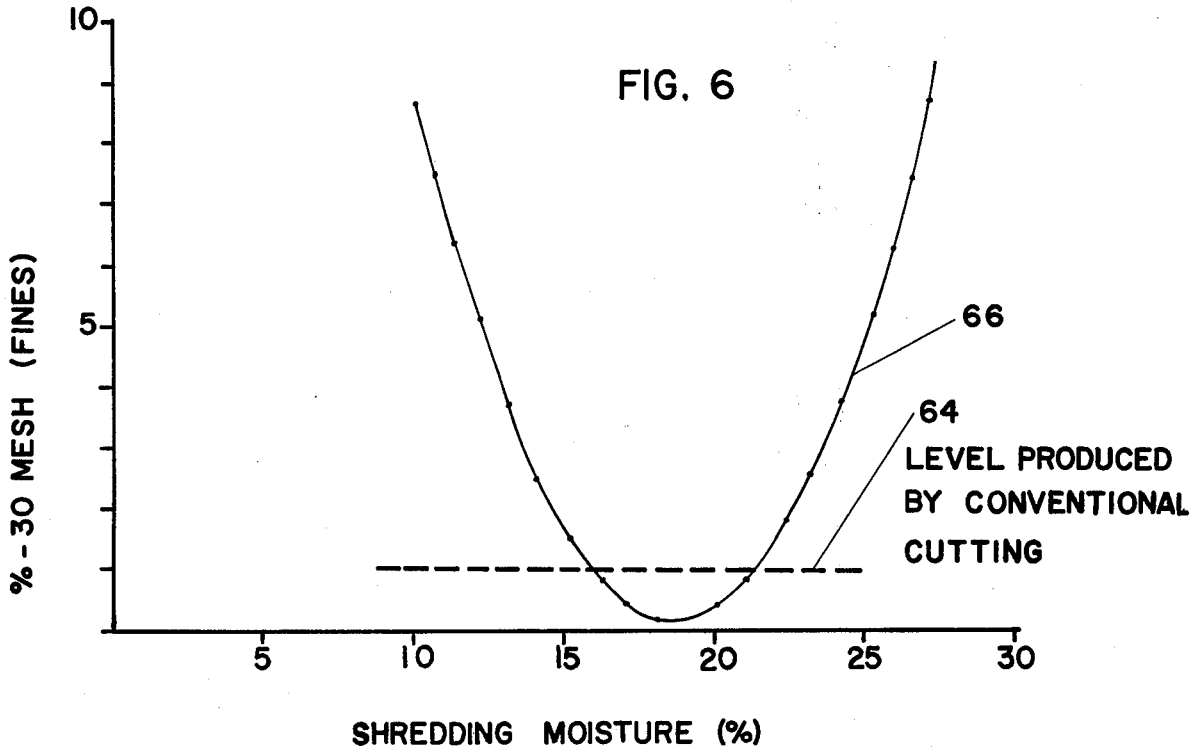

The shredded material of Example 2 was screened over a 30 mesh sieve to determine the level of fines generated at the various shredding moistures. The graph of FIG. 6 depicts the functional dependence of the generated fines on moisture levels at shredding. The dashed line 64 represents the 1% level, while line 66 illustrates fines generations as a function of the moisture level. It was found that between about 16 and 21%, and, particularly, at about 18%, fewer fines were generated than by conventional cutting. Thus, by considering both crimping/fill value and fines generation, it was determined that a moisture range of between about 16 and 23% is preferable.

EXAMPLE 4

Using a shredder design similar to that shown in FIG. 3, but having a disk overlap to a diameter ratio of 0.0312, as compared to the preferred ratio of 0.125, reconstituted sheet material at 20% moisture level (identical to that of Example 1) was shredded as in Example 2. The resulting strips had a filling value of 165 mg/cc, which is notably similar to the filling value of the uncrimped strips of Example 1. This demonstrates that crimping occurs only when a specific ratio of overlap to diameter is exceeded.

EXAMPLE 5

Strips of reconstituted sheet material were formed as in Example 4, except the disk overlap to diameter ratio of the shredder assembly was increased to 0.045. The fill power of the strips was determine to be 149 mgs/cc, showing an increase in crimping over the strips of Example 4. It was further determined that a disk overlap to a diameter ratio of at least 0.045 is necessary before any significant increase in fill value/crimping occurs.

EXAMPLE 6

The crimped strips of Example 2 were blended with conventional cut tobacco and fabricated into cigarettes. The reconstituted content of the winnowers removed from the maker was 0.7%, as opposed to 20% content in the winnowers of Example 1. Thus, it is apparent the loss of reconstituted material is significantly reduced when shredding in accordance with the present invention.

EXAMPLE 7

Double and triple thickness of reconstituted sheet were fed into the shredder as employed in Example 2. Moisture content was held between about 17 and 22%. The resulting strips were then analyzed for both generated fines content and crimp. The amount of fines generated was about 2.9% by weight. The filling value was measured at 178 mg/cc. While the crimp was visible, double and triple thicknesses of material were observed. Levels of reconstituted tobacco in the winnowers after cigarette manufacture was measured to be about 28%, which is undesirably high. Thus, feeding a monolayer, as opposed to a multilayer, sheet into the shredder is preferred.

EXAMPLE 8

A reconstituted tobacco sheet produced by casting of a substantially homogenized slurry on a moving stainless belt was shredded to produce strips parallel to the direction of the belt movement. Another batch was shredded to produce strips perpendicular to the movement. Samples of each were subjected to a test procedure which determines the potential to generate fines. Shredding parallel to belt direction gives shreds with a potential to form fines of 5.4%, while shredding perpendicular gives rise to a potential of 7.4%. It is, therefore, advantageous to shred in the direction of casting.

EXAMPLE 9

A shredder design similar to that shown in FIGS. 2 and 3, but fabricated to produce strip widths of about 0.51 mm, as in Example 2, was not found capable of sustaining continuous operation. Rapid deterioration of the cutter disk and guides resulted after limited operation. The strips produced from a sheet identical to the sheet of Example 1 had a fines generation potential of 31%.

EXAMPLE 10

Strips of reconstituted tobacco were made in accordance with Example 9, except the strip widths were about 0.65 mm. The fines generation potential was about 12%, which is the upper limit of acceptability. Larger strip widths were noted to have lower fines generating potential.

EXAMPLE 11

A shredder design identical to that employed in Example 2 was used to produce strip having widths about 1.6 mm and above. No difficulty in shredding was observed. The blend uniformity was not acceptable, however, since a coefficient of variation of 0.405 was measured, as compared to 0.210 when conventional cut tobacco and cut reconstituted sheet are blended. To achieve more uniform blend, more work would have been required, which, in turn, would have resulted in degradation of the tobacco and reconstituted strips.

EXAMPLE 12

Numerous attempts were made to produce crimped strips at various moisture levels with an apparatus identical to that depicted in FIGS. 2 and 3, except that rotating knife blade disks were substituted for the planar, flat-edge disks therein. No crimp on any of the strips produced was discernible. Additionally, it was continually necessary to sharpen the knife-edges during the cutting.

It should be understood that various modifications and alterations may be made in the light of the foregoing description and examples without departing from the spirit of the invention, as defined in the following claims.

It is claimed:

1. A process for simultaneously shredding and crimping a sheet of tobacco material comprising the steps of:

a. maintaining the moisture level of the sheet between about 15 to 30% by weight and b. moving the sheet between a pair of rotating and intermeshing stacks of disks having a predetermined overlap ratio and spacing between opposing disks such that the sheet is shredded into a plurality of strips about 0.65 to 1.55 mm in width and the forward motion of each strip is retarded by engagement with the facing surfaces of neighboring disks causing buckling to occur across each strip, thereby resulting in each strip attaining a crimped configuration.

2. The process of claim 1 wherein the sheet is monolayer.

3. The process of claim 1 wherein the sheet is cast and shredded in the direction of the cast.

4. The process of claim 1 wherein the sheet is maintained at a moisture level of between 16 and 23% by weight.

5. An apparatus for the shredding of a sheet of tobacco material into crimped strips about 0.65 to 1.55 mm in width comprising a. means for moving a sheet of tobacco material;

b. shredder means for receiving said sheet and shredding the sheet into a plurality of strips while reducing the linear velocity of said strips to effect crimping thereof, said shredder means including a pair of intermeshing stacks of planar disks of substantially uniform thickness, having an overlap ratio not less than 0.045, said overlap ratio being defined as the ratio of linear overlap between a pair of opposing disks and disk diameter, wherein the distance between opposing disks is between 11% and 46% of the width of the disks, said disk width being slightly less than the width of the desired strip;

c. drive means for rotating said stacks in opposing directions;

d. guide means for guiding the crimped sheets from between neighboring disks of a stack; and e. conveyor means for receiving crimped strips falling from said shredder means.

6. The apparatus of claim 5 in which said guide elements are planar elements extending between and substantially parallel to the planar surfaces of the neighboring disks of each stack.

7. The apparatus of claim 6 in which each of said guide elements has a surface area about 0.135 of the surface area of an adjacent neighboring disk.

* * * * *